US005881451A

United States Patent [19]

Kneezel et al.

[11] Patent Number: 5,881,451

[45] Date of Patent: Mar. 16, 1999

[54] SENSING THE TEMPERATURE OF A PRINTHEAD IN AN INK JET PRINTER

[75] Inventors: Gary A. Kneezel; Joseph J. Wysocki, both of Webster; Thomas P. Courtney, Fairport; Juan J. Becerra, Webster; Thomas E. Watrobski, Penfield; Joseph F. Stephany, Williamson; Richard V. LaDonna, Fairport, all of N.Y.

[73] Assignee: Xerox Corporation, Stamford, Conn.

[21] Appl. No.: 668,054

[22] Filed: Jun. 21, 1996

[51] Int. Cl.[6] ..... H01C 7/06

[52] U.S. Cl. ..... 29/612; 338/22 R; 347/14; 347/17

[58] Field of Search ..... 29/612; 338/22 R, 338/195; 347/14, 17; 374/141, 183, 185

[56] References Cited

U.S. PATENT DOCUMENTS

| | | | |
|---|---|---|---|
| Re. 32,572 | 1/1988 | Hawkins et al. | 156/626 |
| 4,571,599 | 2/1986 | Rezanka | 346/140 R |
| 4,772,866 | 9/1988 | Willens | 338/225 D |
| 4,980,702 | 12/1990 | Kneezel et al. | 346/140 R |
| 5,075,690 | 12/1991 | Kneezel | 346/1.1 |
| 5,168,284 | 12/1992 | Yeung | 346/1.1 |
| 5,220,345 | 6/1993 | Hirosawa | 346/1.1 |
| 5,221,397 | 6/1993 | Nystrom | 156/273.5 |
| 5,223,853 | 6/1993 | Wysocki et al. | 346/1.1 |
| 5,315,316 | 5/1994 | Khormaee | 346/1.1 |

*Primary Examiner*—P. W. Echols

[57] ABSTRACT

An improved temperature compensation method is disclosed in which a temperature sensing thermistor is formed on a substrate whose temperature is to be series of fractional thermistors which are selectively shorted out during a manufacturing process to provide a compensation for manufacturing variabilities of the temperature coefficient of resistance of the thermistor.

4 Claims, 4 Drawing Sheets

SENSING THE TEMPERATURE OF A PRINTHEAD IN AN INK JET PRINTER

The present invention relates to an ink jet printer and, more particularly, to a system and method for sensing the operating temperature of a printhead by means of a thermistor whose resistance and thermal coefficient of resistance are compensated for by auxiliary thermstors and resistor elements in order to improve the accuracy of the temperature measurement.

Inkjet printers eject ink onto a print medium such as paper in controlled patterns of closely spaced dots. To form color images, multiple arrays of ink jet channels are used, with each array being supplied with ink of a different color from an associated ink container. Thermal ink jet printing systems use thermal energy selectively produced by resistors located in ink filled channels or chambers near channel terminating nozzles. Firing signals are applied to the resistors through associated drive circuitry to vaporize momentarily the ink and form bubbles on demand. Each temporary bubble expels an ink droplet and propels it toward a recording medium. The printing system may be incorporated in either a carriage type printer or a pagewidth type printer. A carriage type printer, such as the type disclosed, for example, in U.S. Pat. Nos. 4,571,599 and Re. 32,572, generally include a relatively small printhead containing ink channels and nozzles. The contents of these patents are hereby incorporated by reference. The printhead is usually sealingly attached to one or more ink supply containers and the combined printhead and container form a cartridge assembly which is reciprocated to print one swath of information at a time on a stationarily held recording medium, such as paper. After the swath is printed, the paper is stepped a distance equal to the height of the printed swath, so that the next printed swath will be contiguous therewith. The procedure is repeated until the entire page is printed. The pagewidth printer has a stationary printhead having a length equal to or greater than the width of the paper. The paper is continually moved past the pagewidth printhead in a direction normal to the printhead length at a constant speed during the printing process. An example of a pagewidth printer is found in U.S. Pat. No. 5,221,397, whose contents are hereby incorporated by reference.

A known problem with thermal ink jet printers is the degradation in the output print quality due to increased volume of ink ejected at the printhead nozzles resulting from fluctuations of printhead temperatures. These temperatures produce variations in the size of the ejected drops which result in the degraded print quality. The size of ejected drops varies with printhead temperature because two properties that control the size of the drops vary with printhead temperature: the viscosity of the ink and the amount of ink vaporized by a firing resistor when driven with a printing pulse. Printhead temperature fluctuations commonly occur during printer startup, during changes in ambient temperature, and when the printer output varies.

When printing text in black and white, the darkness of the print varies with printhead temperature because the darkness depends on the size of the ejected drops When printing gray-scale images, the contrast of the image also varies with printhead temperature because the contrast depends on the size of the ejected drops. When printing color images, the printed color varies with printhead temperature because the printed color depends on the size of all the primary color drops that create the printed color. If the printhead temperature varies from one primary color nozzle to another, the size of drops ejected from one primary color nozzle will differ from the size of drops ejected from another primary color nozzle. The resulting printed color will differ from the intended color. When all the nozzles of the printhead have the same temperature but the printhead temperature increases or decreases as the page is printed, the colors at the top of the page will differ from the colors at the bottom of the page. To print text, graphics, or images of the highest quality, the printhead temperature must remain constant.

Various printhead temperature controlling systems and methods are known in the prior art for sensing printhead temperature and using sensed temperature signals to compensate for temperature fluctuations or increases.

U.S. Pat. No. 5,220,345 discloses a printhead temperature control system which places a plurality of temperature detectors at different positions and monitors the temperature differences to control ink supplied to the associated ink channels.

U.S. Pat. No. 5,315,316 discloses a printhead temperature control circuit which includes a temperature sensor formed on the printhead substrate. Analog signals from the sensor are delayed and analyzed by a data processor. A temperature summing operation is performed during a print operation, the sum compared to a previously stored value to determine whether ink flow through the printhead is sufficient for continued printing.

U.S. Pat. No. 5,168,284 discloses a closed loop system which produces non-printing pulses in response to a difference between a reference temperature signal and printhead temperature signals produced by a temperature sensor located on the printhead.

U.S. Pat. No. 5,223,853 to Wysocki et al. discloses a method of controlling the spot sizes printed by a thermal ink jet printer. The temperature of the ink in the printhead is sensed and a combination of power level and time duration of the electrical input signal to the heating elements is selected by entering the sensed temperature of the ink into a predetermined function relating to the energy of the input signal to the corresponding resulting size of the spot on the copy sheet.

U.S. Pat. No. 4,980,702 discloses a printhead in which the thermistor is formed in a recess formed in a heater substrate in close proximity to the heater resistors.

U.S. Pat. No 5,075,690 discloses an analog temperature sensor for an ink jet printhead which achieves a more accurate response by forming the thermistor on the printhead substrate and of the same polysilicon material as the resistors which are heated to expel droplets from the printhead nozzles.

Those prior art disclosures which form the temperature sensor on the printhead are preferred because fairly accurate output signals representing sensed temperatures are generated and used to control printhead temperature or adjust the ejected drops.

SUMMARY OF THE INVENTION

One problem associated with the integrated thermistor is manufacturing variability when forming the thermistor. The variability is manifested by temperature measuring errors which may be unacceptably large at the extremes of the temperature range of interest. Two examples are given to illustrate this variability. In the first example, the printhead temperature is monitored by a temperature sensor integrated onto the heater substrate and made of the same material, polysilicon, as the heater resistors. U.S. Pat. No. 4,772,866 discloses formation of such thermistors. The content of this, and all patents referenced supra, is hereby incorporated by reference.

Polysilicon is the same material as is used in the thermal ink jet bubble nucleating heaters. Its sheet resistance is on the order of 40 ohms per square and its temperature coefficient of resistance is on the order of 0.001 per °C. Since the preferred nominal value of thermistor resistance (for simplification and accuracy of thermistor reading circuitry) is in the range of 5000 to 20,000 ohms, the typical polysilicon thermistor will need to be about 125 to 500 times as long as it is wide. As described in U.S. Pat. No. 5,075,690, referred supra, one natural place to put such a long narrow thermistor is in a line parallel to the row of heater elements. Such a configuration is very quick to respond to changes in average temperature near the heater elements (on the order of a millisecond). Preferably the two leads of the thermistor should be brought out independent of other leads on the thermal ink jet die, such as ground, in order to minimize spurious errors in the thermistor reading. The polysilicon thermistor has a relatively small thermal coefficient of resistance (TCR). This has two implications. First of all, it has a relatively small signal to noise ratio in measuring temperature changes. Secondly, it is not practical to fabricate an accurate polysilicon thermistor without either calibrating each one, or biasing the thermistor with a trimmable resistor in series with the thermistor. This is because in the processes used to make the polysilicon thermal ink jet heaters, the manufacturing variability of the polysilicon resistance is ±5%. For a temperature coefficient of resistance of 0.001 per ° C., such a manufacturing variability, if uncompensated, corresponds to a range of temperature measurements of ±50° C. Because the desired accuracy of the thermistor is on the order of 1° to 3° C., some means of compensation is required. As described in the previously cited U.S. Pat. No. 5,075,690, by trimming a resistor in series with the thermistor when the printhead is at a set point at the center of the temperature range of interest, it is possible thereafter to measure that set point temperature with an accuracy of 1° C. or better. As cited in the patent, if the nominal resistance of the polysilicon thermistor is 20,000 ohms and its temperature coefficient is 0.001 per ° C., then a change of 1° C. corresponds to a thermistor change in resistance of 20 ohms. The ±5% variation in polysilicon resistance corresponds to a range of ±1000 ohms at the given temperature. Thus, to enable accurate readings at the temperature set point, the series resistor must have a trimming range of 2000 ohms, for example from 3000 ohms (for devices in which the polysilicon is at its maximum resistance) up to 5000 ohms (for devices in which the polysilicon is at its minimum resistance). Subsequent accuracy of the temperature measurement at the set point is determined as follows:

It is routine to trim resistors to an accuracy of 0.1%. Furthermore, according to thick film resistor paste specifications, the stability of a laser trimmed resistor during its lifetime (under load and under heat) is typically 0.2%. (For example, the TCR of thick film resistors can be made to be 0.00005/° C., so that over a temperature excursion of ±20° C., the resistor value would vary by ±0.1%.) Thus the total error should be 0.3% or less, which is equivalent to 15 ohms for a 5000 ohm trimmed resistor. Since in this example, a change of 20 ohms is equivalent to 1° C., a 15 ohm error is equivalent to a 0.75° C error in reading the temperature set point. However, what the 0.690 patent neglects to compensate for is manufacturing variability in the temperature coefficient of resistance. The temperature coefficient of resistance is expected to vary by no more than ±10%, since the resistance itself is held to within ±5%. FIG. 1 shows the error in reading the temperature over a temperature range of the temperature set point ±24° C. if the measuring circuitry assumes a polysilicon TCR of 0.0010/° C., when in fact it could be 0.0009/° C. to 0.0011/° C. For a temperature set point of 36° C., this temperature range would be from 12° C. to 60° C. which spans the temperature range of interest for thermal ink jet printing. As seen in FIG. 1, the contribution of manufacturing variation in polysilicon TCR to temperature error at the extremes of the range of temperature would be approximately ±2° C. Coupled with the possible error in the set point, the total error could range up to ±3° C., which is marginally adequate, and may, in fact, be inadequate for some systems.

A second example of a temperature sensor formed on a thermal ink jet printhead is the drift thermistor which is made by diffusing an n-type impurity into the p-type silicon substrate on which the heaters and associated drivers and logic reside. An equivalent circuit is shown in FIG. 2. The ground shield is an aluminum encapsulating layer which stabilizes the upper surface of the thermistor. The diode in parallel with the n-type body represents the depletion layer separating the n-type body from the p-type substrate. As a consequence of this diode, the drift thermistor should never be biased negatively with respect to the substrate; only positive bias can be used.

Fabrication of the drift thermistor is consistent with processes used to fabricate the driver transistors on the Xerox printhead used in the Xerox 4004 printer. The sheet resistance is typically 5000 ohms per square and the temperature coefficient of resistance is typically 0.005/° C. To provide the desired thermistor resistance, the optimal configuration for the drift thermistor is a square, or a rectangle with a length to width ratio typically between 0.1 and 10. For the case of a single drift thermistor per thermal ink jet die, a convenient place to situate the drift thermistor is at the back of the die in the row of wire bond pads, and roughly centered with respect to the row of heaters. In this way, the thermistor reads the average temperature. In this location the drift thermistor responds less quickly to the heater temperature than the polysilicon thermistor described earlier. Measurements indicate a response time of about 40 milliseconds, but this response time is still fast enough to be useful for on-the-fly spot size control. Because the TCR of the drift thermistor is larger than that of the polysilicon thermistor, its signal to noise ratio is better. However, it is still required to calibrate each drift thermistor or to incorporate external circuitry with, for example, a trimmable resistor. This is because the manufacturing latitude of the drift thermistor has a broad resistance range, so that the resistance can vary by as much as a factor of two. The TCR can also vary significantly. As a result, the temperature error for the drift thermistor can be even larger than that of the polysilicon thermistor when the same prior art strategy is used—i.e., trimming an external resistor at a given set point temperature and assuming a midpoint TCR. This temperature error is shown in the calculated curves of FIG. 3 in which the TCR ranges due to manufacturing variabilities from 0.003/° C. to 0.006/° C., but is assumed to be midway between at 0.0045/° C. Temperature measurement error becomes more pronounced for actual temperatures which are farther from the set point temperature $T_o$ at which the compensating resistor is trimmed in the prior art approach, due to deviations in the temperature coefficient of resistance from the assumed 0.0045/° C. for the drift thermistor. The large errors at the extremes of the range which can be as much as ±8° C. are not acceptable.

Those prior art temperature sensing techniques which utilize thermistors, or sensors, located on the printhead are preferred because of the fast response to temperature changes. The most cost efficient thermistor manufacturing technique is to fabricate the sensor as part of the substrate in which the heater resistors are formed.

It is a first object of the invention to form a temperature sensor on a printhead with increased accuracy in sensing the temperature of the printhead.

It is a further object to manufacture a thermistor on a printhead substrate by compensating for the manufacturing variability in establishing the temperature coefficient of resistance for the thermistor.

These, and other objects of the invention are realized by manufacturing the thermistor with a novel compensation circuit which minimizes all possible errors including manufacturing TCR variability of printhead temperature sensing. The compensation circuit is fabricated in proximity to the main thermistor; one or more auxiliary thermistor of the same type but of lower resistance which may be used in combination with an externally trimmed resistance to eliminate much of the temperature error.

More particularly, the present invention relates to a method for sensing the temperature of a silicon substrate comprising the steps of:

forming a temperature sensing thermistor on the substrate, forming a plurality of thermistors adjacent to, and made with the same materials and processes as, the said temperature sensing thermistor such that said adjacent thermistors have substantially the identical thermal coefficient of resistance as the temperature sensing thermistor, and incorporating the said temperature sensing thermistor and one or more of the said plurality of adjacent thermistors into electrical circuitry which provides a temperature-dependent output less susceptible to error due to manufacturing variabilities in thermal coefficient of resistance than if the said one or more of the said plurality of thermistors had not been incorporated.

DESCRIPTION OF THE INVENTION

The present invention is described in the context of increasing the temperature sensing accuracy of a drift thermistor since, as discussed above, this type of sensor was subject to the largest errors at the extremes of the temperature range of interest. The invention, however, has applicability with other types of thermistors formed on or in a printhead substrate, or more generally to compensation for thermistor variability in applications other than printheads.

Figure 4:
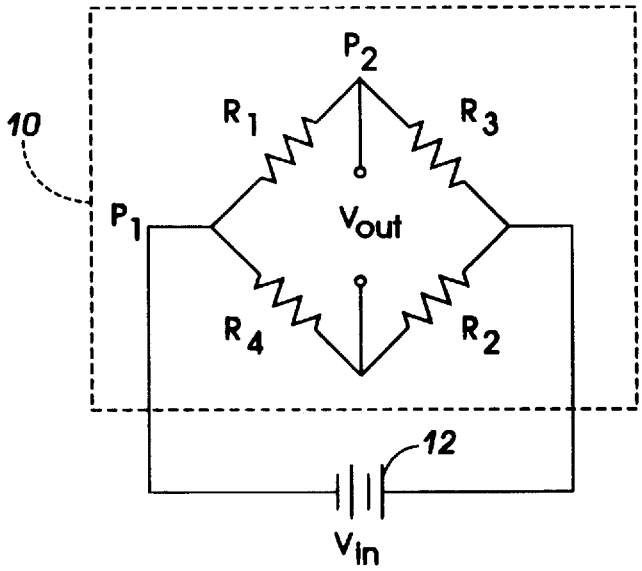
FIG. 4 PRIOR ART
FIG. 4 is a schematic electrical diagram of a prior art bridge circuit used to produce the voltage which changes in response to changes in the resistance of one of the legs.

In the prior art reference '690, bridge circuitry such as that shown in FIG. 4, was used to produce a voltage whose magnitude was dependent upon the output of a thermistor. Referring to FIG. 4, bridge circuit 10 has resistors in four legs (designated $R_1$ to $R_4$ with the sensor thermistor included in leg $R_1$. An external voltage $V_{in}$ is applied from a voltage source 12 and the bridge voltage $V_{out}$ is dependent upon the relationship of the resistances in the legs; e.g., changes in response to changes in the resistance of one or more legs. The general bridge equation for $V_{out}$ is:

$$V_{out} = \frac{V_{in}(R_1R_2 - R_3R_4)}{(R_1 + R_3)(R_2 + R_4)} \quad \text{(Eq 1)}$$

By setting $R_2=R_4$ this simplifies to $$V_{out} = \frac{V_{in}(R_1 - R_3)}{2(R_1 + R_3)} \quad \text{(Eq 2)}$$

In the prior art of cited U.S. Pat. No. 5,075,690, $R_1$ has been set equal to $R_3$ at some set temperature $T_o$, by trimming a resistor in series with the thermistor in $R_1$, or in leg $R_3$. For simplicity in discussing prior art, let $R_1=r_o(1+a\ \Delta T)$ where $R_1=R_t$ is the thermistor having resistance $r_o$ at $T_o$ and having TCR=a. $\Delta T=T-T_o$. In prior art one might trim $R_3=r_o$ when $T=T_o$. In this embodiment of prior art, according to Equation 2.

$$V_{out} = \frac{V_{in}a\Delta T}{2(2 + a\Delta T)} \quad \text{(Eq 3)}$$

so that $$\Delta T = \frac{4V_{out}}{a(V_{in} - 2V_{out})} \quad \text{(Eq 4)}$$

Figure 1:
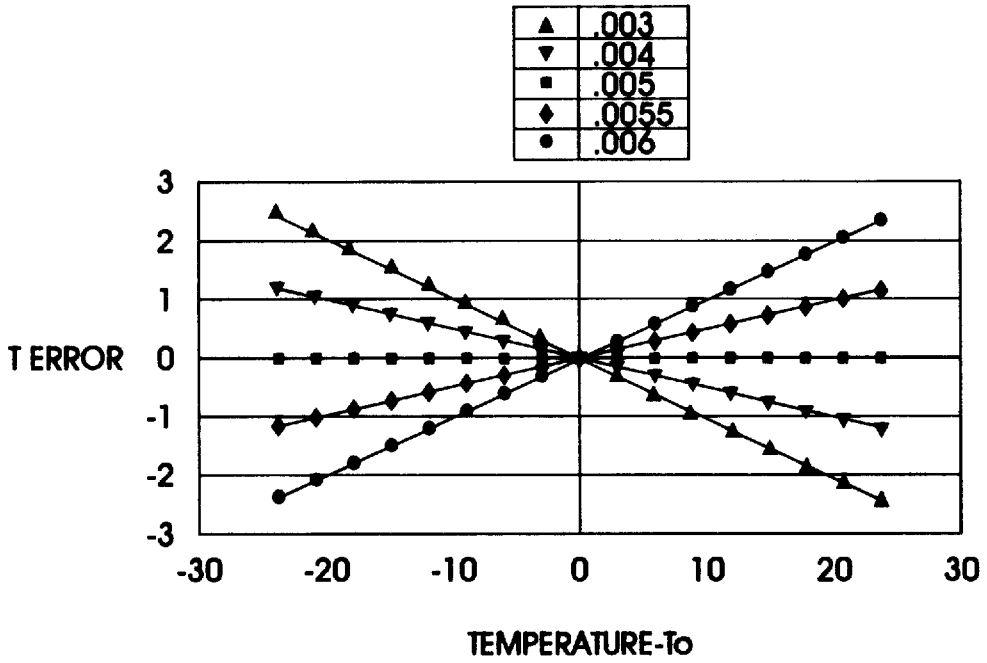
FIG. 1 is a plot of temperature measurement error range due to the temperature coefficient of resistance (TCR) manufacturing variations of a polysilicon thermistor.
Figure 2:
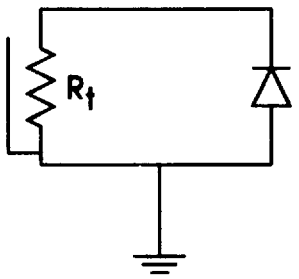
FIG. 2 is an equivalent circuit diagram of the drift thermistor formed in a p-type silicon substrate.

In practice in the prior art, there is manufacturing variability in the TCR, so that a certain TCR=A is assumed. In calculating the error in $\Delta T$ for FIG. 1 and FIG. 3, the actual TCR=a for each case was used to calculate $V_{out}$ using Equation 3, and the assumed TCR=A was used to calculate $\Delta T$ using Equation 4 (where A=0.001/° C. was used for FIG. 1, and A=0.0045/° C. was used for FIG. 3).

Figure 5:
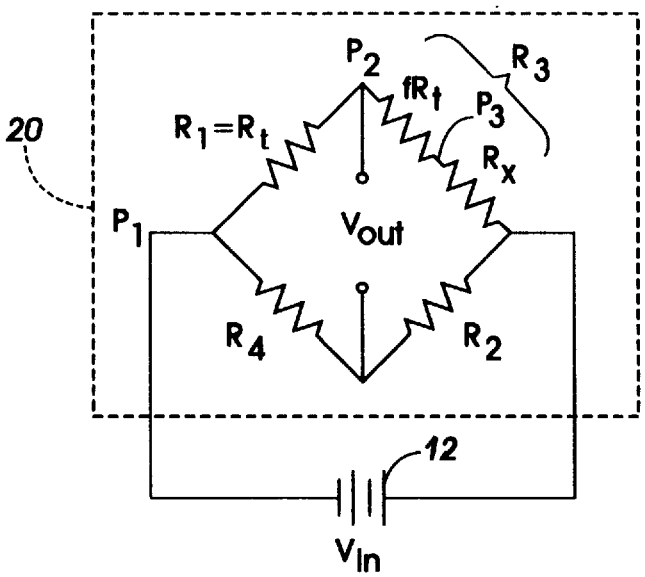
FIG. 5 is a schematic electrical diagram of the bridge circuit of FIG. 4 modified according to the invention by manufacturing one resistive leg to include fractional resistors.
Figure 6:
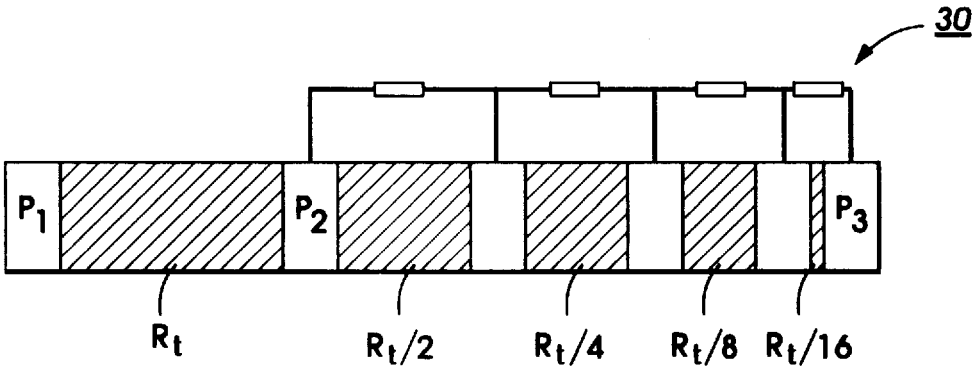
FIG. 6 a portion of a printhead substrate fabricated to include a thermistor connected to the fractionally adjusted resistor.

In the present invention, the measurement error is minimized by incorporating into the $R_3$ leg not only a trimmable external resistance, but also a series of thermistors which are made of the same material as the sensor thermistor $R_t$ and are in close proximity to it. By shorting out various combinations of these "fractional" thermistors, a variety of combinations can provide a resistance in $R_3$ having the same coefficient of resistance as $R_t$, but having a nominal value of $fR_t$ where f is typically less than 1 in order to accommodate the entire range of manufacturing variability in thermistor TCR. FIG. 5 shows a bridge circuit showing a modified $R_3$ leg; FIG. 6 shows one way to implement the proposed configuration of thermistors on the chip.

Referring to FIG. 6, thermistor $R_t$ is shown in series with several other thermistors of the same material but having fractionally lower resistances. Thermistor $R_t$ is twice as long as it is wide (for example, 200 microns by 100 microns). Each of the fractional thermistors has the same width but successively smaller lengths until the smallest one ($R_t/(16)$ has a length, for example, of 12.5 microns. All the thermistors are shown as cross-hatched. The white pads are wire bonding pads, typically aluminum. The thermistor sensor $R_t$ is placed in the $R_1$ leg of the bridge, between pads $P_1$ and $P_2$, so that $R_1=R_t=R_o$ (1+a ΔT) where $R_o$ is the resistance a+$T_o$and Δt=T−$T_o$. In the $R_3$ leg, the selected combination of fractional resistors between pads $P_2$ and $P_3$ are in series with a trimmable external resistor $R_x$. In parallel with each fractional resistor is a fusible link shorting bar 30. The fuisible links may be blown electrically or cut by laser to give any combination of fractional thermistor resistance from 0 to 15$R_t$/16 in increments of $R_t$/16. It can be demonstrated that $R_3=R_x+fr_o$ (1+a ΔT) where the TCR=a of the fractional thermistor is essentially identical to that of $R_t$ due to the proximity.

The bridge output voltage is given by substituting the value of $R_1$ and $R_3$ into equation (2).

$$V_{out} = \frac{V_{in}(r_o(1 + a\Delta T) - fr_o(1 + a\Delta T) - R_x)}{2(r_0(1 + a\Delta T) + fr_0(1 + a\Delta T) + R_x)} \quad \text{(Eq 5)}$$

If $R_x$ is trimmed to the value $r_o$(1−t), then Equation 5 reduces to $$V_{out} = \frac{V_{in}(1 - f)a\Delta T)}{2(2 + (1 + f)a\Delta T)} \quad \text{(Eq 6)}$$

This may be rearranged to give $$\Delta T = \frac{4V_{out}}{a(V_{in}(1 - f) - 2(1 + f)V_{out})} \quad \text{(Eq 7)}$$

Typically, $V_{out}$ is less than 4% of $V_{in}$ even at the extremes of the temperature range.

Therefore, a reasonable approximation of Equation 7 (which is most accurate for f=0) is $$\Delta T \sim \frac{4V_{out}}{a(1 - f)\,(V_{in} - 2V_{out})} \quad \text{(Eq 8)}$$

$$\Delta T \sim \frac{4V_{out}}{B(V_{in} - 2V_{out})} \qquad \text{for } f = 1 - B/a \quad \text{(Eq 9)}$$

The algorithm for selecting which fusible inks to sever, as well as setting the value to trim the external resistance to minimize the error of measuring ΔT=T−$T_o$ is as follows: Define B to be the minimum TCR which is allowed by manufacturing variability. Measure the actual TCR=a for the thermistor $R_t$ of a given printhead die. Then sever the combination of fusible links on the printhead die such that the combination of fractional thermistors not shorted out in leg $R_3$ have a total resistance of fRt where f is substantially equal to 1-B/a. Finally, trim the external resistor $R_x=r_o$) (1−f) where $r_o$ is the value $R_t$ at T=$T_o$.

EXAMPLE

Figure 3:
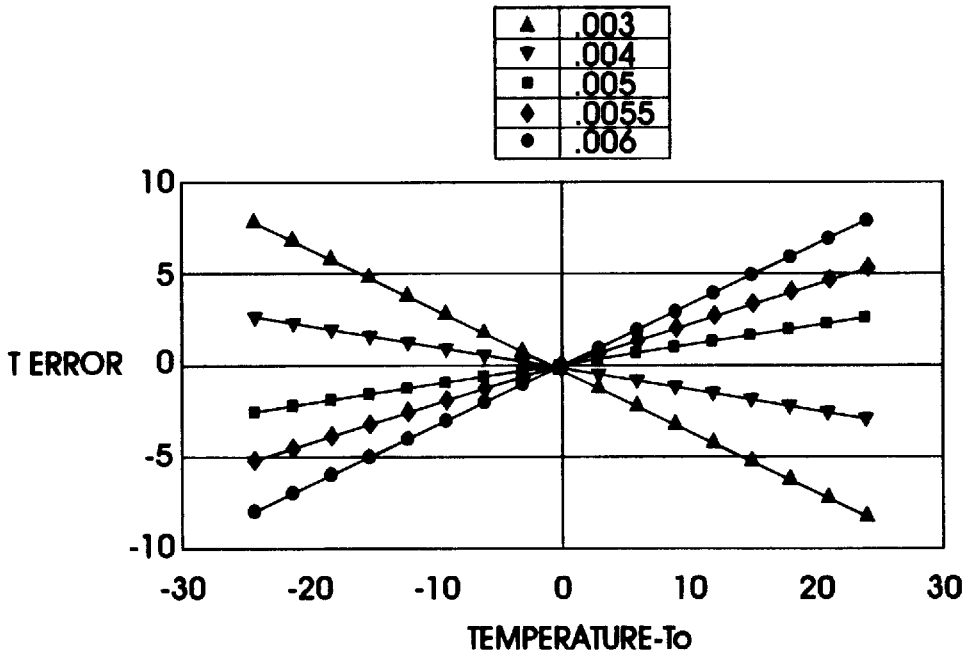
FIG. 3 is a plot of temperature measurement error range due to TCR manufacturing variation of a drift thermistor.

As an example of minimizing the error in measuring ΔT of Equation 9, certain assumptions will first be made. A minimum value of TCR, allowable by manufacturing variability, is selected. As shown in FIG. 3 for the drift thermistor case, a minium TCR=B for $R_t$ is 0.003/° C. The actual TCR=a is measured for the specific thermistor $R_t$ formed on a given printhead die. (A convenient point at which to make this measurement is during wafer probe testing by measuring all thermistors on the wafer at room temperature and then remeasuring all thermistors while the wafer is held on a hot stage.) Assume that the actual measured TCR is 0.004/° C. for the particular die in this example.

$$f = 1 - \frac{0.003}{0.004} = 0.25.$$

The fusible link associated with $R_t$/4 in bar 30 is then blown thereby shorting out that resistor so that resistance of non-shorted fractional resistors in leg $R_3$ is f$R_t$=0.25$R_t$. External resistor $R_x$ is then trimmed to satisfy the equation $R_x=r_o$(1−f)=0.75 $r_o$ where $r_o$ is the value of $R_t$ at $T_o$.

Figure 7:
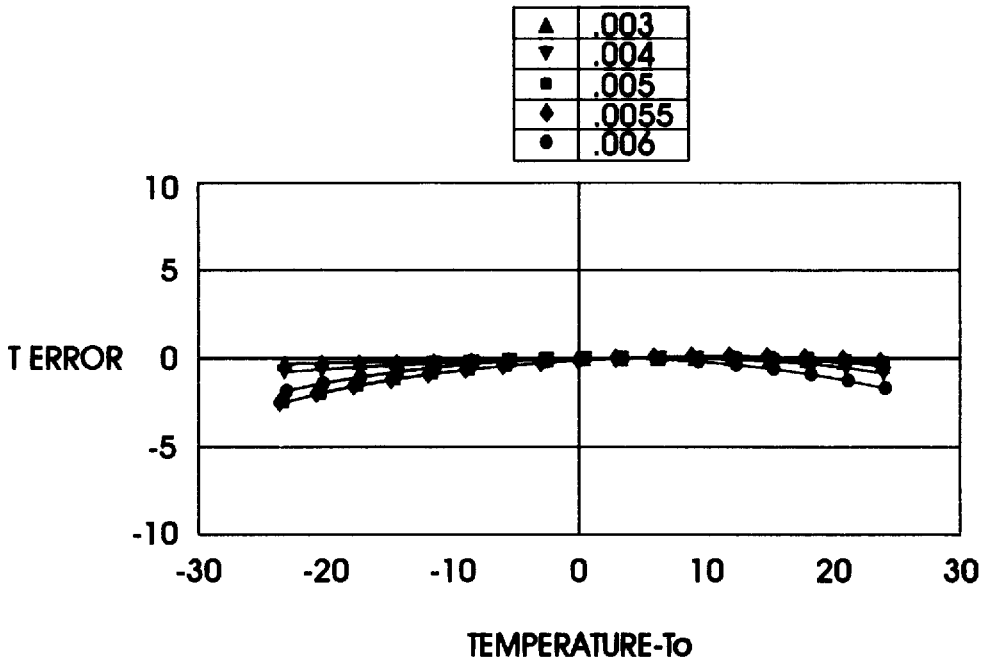
FIG. 7 is a plot of temperature measurement error range due to TCR manufacturing variations of a drift thermistor forming part of the circuit of FIG. 5.

FIG. 7 shows the significant temperature measurement error reduction relative to the prior art of FIG. 3 for the drift thermistor. The same manufacturing variabilities in TCR=a are used in FIG. 7 as in FIG. 3. Since the maximum TCR considered (0.006/° C.) is not less than twice the minimum TCR considered (0.003/° C.), the FIG. 6 configuration is used in which the $R_t$/2 fractional thermistor is included as well as the $R_t$/4, $R_t$/8 and $R_t$/16 fractional thermistors. In calculating the error in measuring ΔT for FIG. 6, the actual TCR=a for each case was used to calculate $V_{out}$ using Equation 6, where f was set equal to the nearest possible value of f=1-B/a in the steps of 1/16 provided by the FIG. 6 configuration, and B is set to the assumed minimum value of a (0.003/° C.). Equation 9 was then used to calculate ΔT for each assumed value of ΔT, and the difference between these two values is the temperature error plotted in FIG. 7. Note that Equation 9 does not require that the value of f used on the printhead is known. Thus, this algorithm assumes that all adjustments in fractional thermistors and external resistors are made at the factory, and no special measurements or adjustments need to be made for different printheads by the user or the printer. As can be seen in FIG. 7, this new invention greatly reduces the temperature measurement error. The measurement error is largest when ΔT is at the end of its range (e.g. at ±24° C. in the example), when the TCR is far from its minimum value B (i.e. for larger values of TCR and consequently larger values of f), and when the allowable steps in f (due to the 1/16 step increments) are not as well matched to the calculated f Thus, in FIG. 7, the largest error (−2.3° C.) in measured ΔT occurs at the assumed value ΔT=−24° C. for the case TCR=a=0.0055/° C. Even though the case TCR=a=0.006/° C. has a larger TCR, its calculated f=0.5 is exactly equal to one of the allowable steps from f=0 to f=15/16 provided by the FIG. 5 configuration in steps of 1/16. For the case TCR=a=0.0055/° C., the calculated f=0.455, and the nearest possible f=0.438. At the +24° C. extreme, the largest error in ΔT occurs for the TCR=a=0.006/° C. and has the value −1.6° C.

Figure 8:
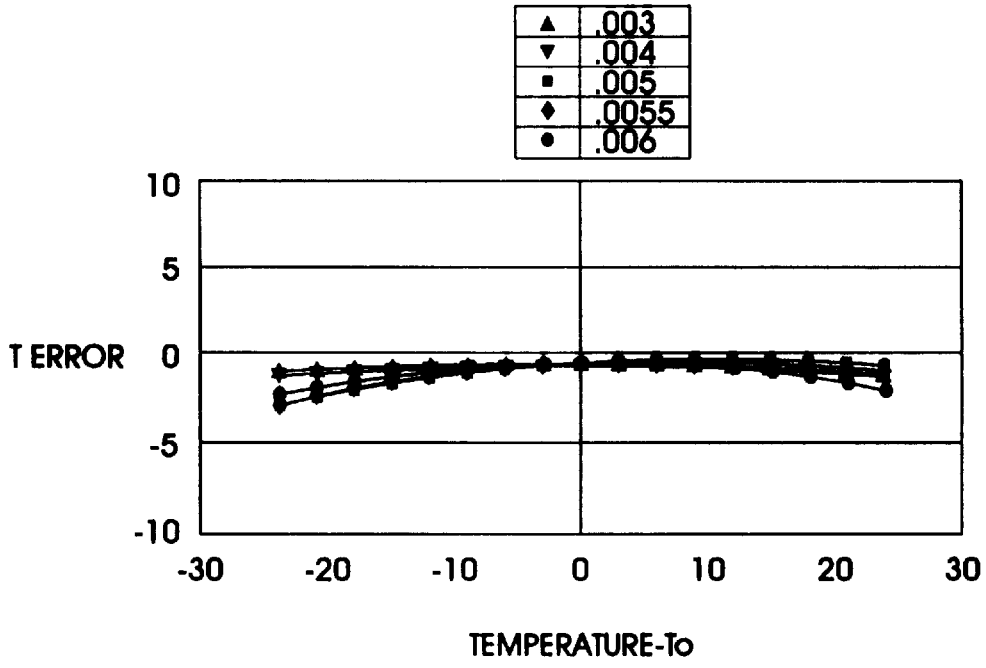
FIG. 8 shows the plot of FIG. 7 modified to include the possible effects of laser trim errors.

The calculations of FIG. 7 do not include errors in trimming the external resistor $R_x$. As was stated earlier, it is routine to laser trim to an accuracy of 0.1%, and the expected stability of a laser trimmed resistor (including temperature excursions) is 0.2%. Thus, an error in $R_x$ of 0.3% should be considered. Since the temperature error in FIG. 7 is predominantly on the negative side (with the largest negative error being −2.3° C. and the largest positive error being 0.2° C.), consider the case where $R_x$ is 0.3% larger than its targeted value of $r_o$(1−f). As seen in FIG. 8, this resistor trimming error shifts the temperature measurement curves of FIG. 7 in a negative direction. Even so, the maximum temperature error in the FIG. 8 case including resistor trimming errors, is −2.8° C. and occurs for TCR=a=0.0055/° C. at −24° C. The largest error at the other end of the temperature range is −2.1° C. which occurs for TCR=a=0.006/° C. at +24° C. Thus, we have improved temperature measurement accuracy from the case of FIG. 3 in which errors of ±8° C. (range of 16° C.) could occur, such that even allowing for trimming errors in our new method, the maximum temperature error is less than 3° C. and the range of errors is also less than 3° C. It is advantageous, both for improving the accuracy of the current invention, and for potential elimination of the $R_t/2$ fractional thermistor, if the manufacturing range of TCR can be controlled to be tighter than a factor of two difference between maximum and minimum values of TCR. However, even if the manufacturing variability is this wide, temperature measurement accuracy of 3° C. across the entire range of temperatures and printheads can still be met.

It is understood that $V_{out}$ in FIG. 5 changes in response to changes in the resistance of thermistor $R_t$ due to changes in temperature of the printhead. $V_{out}$, as is known in the art, can be amplified, converted into a digital signal which is then sent to control circuits in the system controller which monitor temperature changes and provide compensation, for example, changes in the signal pulse with drive signals to individual resistors.

Variants of the embodiment described above are possible. For example, the external resistor $R_x$ is most likely incorporated on the printhead, but it may be set to its desired value of $r_o(1-f)$ in one of several ways. If the electrical connection board for the printhead is made with thick film (or thin film) technology, then the external resistor may be screen printed and fired (or deposited and delineated) as part of the board fabrication, and laser trimmed subsequently as appropriate for the particular value of thermistor and TCR for the thermal ink jet die connected to it. If the electrical connection board is made by printed circuit board technologies, then the external resistor may be a discrete laser-trimmable component which is mounted on the board. Alternatively, one or more discrete resistors of the appropriate total value may be selected from a variety of bins of resistors when the printhead is packaged. Detecting what value of f has been used may also be done in different ways. If fusible links were blown at the wafer probing stage, then when it is time to set the value of $R_x$ during printhead packaging, the ratio of the thermistor resistance between pads $P_2$ and $P_3$ to the thermistor resistance between pads $P_1$ and $P_2$ gives f (See FIG. 6). Alternatively, all of the pads on FIG. 6 may be brought out to the printhead board and non-blown fusible links can be detected as shorts. In fact, the shorting bars for the fractional thermistors could reside on the printhead electrical connection board and f could be set during printhead packaging rather than during wafer probing.

Other variants are possible with regard to the configuration of selectable fractional thermistors. In the FIG. 6 configuration, the thermistors are in series with each other, and each thermistor has a fusible link in parallel with it. Alternatively, the thermistors could be in parallel with each other, with the fusible links in series with each thermistor. Also, the values of fractional thermistors are successively made to have half the resistance of the previous fractional thermistor. This configuration is advantageous for achieving accuracy in f over a wide range using relatively few elements. However, other configurations are also possible.

A further variant is that if TCR value is sufficiently well correlated with the $r_o$ value of the thermistor at temperature $T_o$, then it will not be necessary to measure the thermistors at two different temperatures to determine TCR, but only at $T_o$ and use the correlation to predict TCR. Even if this approach is not accurate enough for the entire range of wafers, it might be useful within a batch of wafers, for example.

In order to increase the bridge output voltage per °C. of temperature change, a relatively large value of input voltage can be used. Typically $V_{in}$ will be on the order of 10 volts. One upper limit is set by self heating of the thermistors. Optionally $V_{out}$ may be amplified to provide increased sensitivity.

It is to be noted that the proposed method of correcting for manufacturing variability of not only the thermistor value at a particular temperature, but also the range of TCR's, does not require any active components on the printhead, but only passive networks. It is therefore compatible with current printhead fabrication technologies. More generally, the idea of using a selectable combination of a nearby series of thermistors plus a trimmable external resistor, applies to any device (not just on thermal ink jet printheads) on which the manufacturing variability of thermistor value and TCR is too large to allow sufficient temperature measurement accuracy and is not limited solely to thermal ink jet printheads.

While the embodiment disclosed herein is preferred, it will be appreciated from this teaching that various alternative, modifications, variations or improvements therein may be made by those skilled in the art, which are intended to be encompassed by the following claims:

What is claimed is:

1. A method for improving the accuracy of a temperature sensing thermistor integrated into a substrate comprising the steps of:

forming a temperature sensing thermistor on the substrate; the thermistor forming one leg of a bridge circuit and having a resistance $R_1=R_t=r_o(1+a\Delta T)$ where a is the temperature coefficient of resistance (TCR); $r_o$ is the resistance at a set point temperature $T_o$ and $\Delta T$ is the difference in temperature between the temperature T to be measured and the set point temperature $T_o$, forming a plurality of fractional thermistors adjacent the temperature sensing thermistor such that their TCR values are substantially identical to that of the temperature sensing thermistor, and having a combined resistance of $fR_1$ where $f=1-B/a$, where B is a preselected minimum TCR value, and including the fractional thermistors and an external resistance $R_x=r_o(1-f)$ in a leg of the bridge circuit which is adjacent to the $R_1$ leg which contains the temperature sensing thermistor.

2. The method of claim 1 wherein said fractional resistor is connected in series with a trimmable resistor and including the further step of trimming said trimmable resistor to a desired resistance value while holding the substrate at a desired nominal set temperature.

3. The method of claim 1 wherein the fractional thermistors are connected across fusible links and including the further step of blowing selected links to achieve the desired value of f.

4. The method of claim 1 wherein one or more of the fractional thermistors may be selectively incorporated into the bridge circuit by selective electrical interconnection to achieve the desired value of f.

* * * * *